US011536011B2

(12) United States Patent
Rosko

(10) Patent No.: US 11,536,011 B2
(45) Date of Patent: Dec. 27, 2022

(54) REDUCED PROFILE FAUCET HANDLE ASSEMBLY

(71) Applicant: Delta Faucet Company, Indianapolis, IN (US)

(72) Inventor: Michael Scot Rosko, Greenwood, IN (US)

(73) Assignee: Delta Faucet Company, Indianapolis, IN (US)

( * ) Notice: Subject to any disclaimer, the term of this patent is extended or adjusted under 35 U.S.C. 154(b) by 65 days.

(21) Appl. No.: 17/306,021

(22) Filed: May 3, 2021

(65) Prior Publication Data

US 2021/0254316 A1 Aug. 19, 2021

Related U.S. Application Data

(63) Continuation of application No. 16/145,060, filed on Sep. 27, 2018, now Pat. No. 11,001,994.

(51) Int. Cl.
*E03C 1/04* (2006.01)

(52) U.S. Cl.
CPC ..... *E03C 1/0401* (2013.01); *E03C 1/0403* (2013.01); *E03C 2201/50* (2013.01)

(58) Field of Classification Search
CPC ... E03C 1/0401; E03C 1/0403; E03C 2201/50
USPC ..... 4/676, 678
See application file for complete search history.

(56) References Cited

U.S. PATENT DOCUMENTS 5,361,431 A 11/1994 Freier et al.
5,946,746 A 9/1999 Bloom
5,947,149 A * 9/1999 Mark ..... F16K 31/602 137/359
6,014,985 A 1/2000 Warshawsky
6,370,712 B1 4/2002 Burns et al.
6,434,765 B1 8/2002 Burns et al.
6,874,527 B2 4/2005 Meeder
6,981,286 B2 1/2006 Sallick
7,658,202 B2 2/2010 Mueller et al.
7,987,869 B2 8/2011 Rosko et al.
8,079,381 B2 12/2011 Fischer et al.
8,881,755 B2 11/2014 Thomas et al.
8,985,137 B2 3/2015 Burgett et al.
9,062,796 B2 6/2015 Horsman et al.
9,631,740 B2 4/2017 Farinella et al.
2009/0250127 A1* 10/2009 Izzy ..... E03C 1/0401 137/606
2011/0073205 A1* 3/2011 Marty ..... E03C 1/0403 137/801
2013/0186478 A1* 7/2013 Zhu ..... E03C 1/0403 137/15.01
2017/0009901 A1 1/2017 Ritter et al.
2018/0195628 A1 7/2018 Tasserit et al.

FOREIGN PATENT DOCUMENTS

WO 2006023166 3/2006

* cited by examiner

*Primary Examiner* — Tuan N Nguyen

(74) *Attorney, Agent, or Firm* — Bose McKinney & Evans LLP

(57) ABSTRACT

A reduced profile faucet handle assembly illustratively includes a mounting shank receiving a valve assembly, and an escutcheon operably coupled to the mounting shank. A mounting ring is positioned intermediate the mounting shank and the escutcheon, and a retainer couples the escutcheon to the mounting ring.

17 Claims, 9 Drawing Sheets

REDUCED PROFILE FAUCET HANDLE ASSEMBLY

CROSS-REFERENCE TO RELATED APPLICATIN

This application is a continuation of U.S. patent application Ser. No. 16/145,060, filed Sep. 27, 2018, the disclosure of which is expressly incorporated herein by reference.

BACKGROUND AND SUMMARY OF THE DISCOSURE

The present invention relates generally to a faucet handle assembly and, more particularly, to a faucet handle assembly coupled to a flow control valve and having a reduced profile.

Conventional handle assemblies for controlling water flow through the outlet of a faucet often include a handle coupled to a rotating valve stem of a flow control valve. A decorative trim or escutcheon may help cover a mounting hole in the sink deck, hide internal faucet handle assembly components, and provide an anesthetically pleasing appearance. In certain designs, it is desired to provide a faucet handle assembly with a reduced profile or height relative to the sink deck.

According to an illustrative embodiment of the present disclosure, a faucet handle assembly configured to be supported by a mounting deck includes a valve assembly having a movable flow control member and a valve stem operably coupled to the flow control member, and a handle operably coupled to the valve stem of the valve assembly. A mounting shank includes a cylindrical body defining an internal chamber and extending longitudinally between an upper end and a lower end, the cylindrical body including internal threads extending downwardly from the upper end and external threads extending upwardly from the lower end, the valve assembly supported within the internal chamber of the mounting shank. A bonnet nut includes external threads engaging with the internal threads of the mounting shank to secure the valve assembly to the mounting shank. An escutcheon is supported intermediate the handle and the mounting shank. A mounting ring is positioned intermediate the mounting shank and the escutcheon. A retainer couples the escutcheon to the mounting ring.

According to a further illustrative embodiment of the present disclosure, a faucet handle assembly configured to be operably coupled to a valve assembly including a movable valve stem, and supported by a mounting deck. The faucet handle assembly includes a valve assembly having a movable flow control member and a valve stem operably coupled to the flow control member, and a handle operably coupled to the valve stem of the valve assembly. A mounting shank includes a cylindrical body defining an internal chamber and extending longitudinally between an upper end and a lower end, the cylindrical body including internal threads and external threads, the valve assembly supported within the internal chamber of the mounting shank. A bonnet nut includes external threads engaging with the internal threads of the mounting shank to secure the valve assembly to the mounting shank. An escutcheon is supported intermediate the handle and the mounting shank. A mounting ring is positioned radially intermediate the mounting shank and the escutcheon, and is positioned axially between the upper flange of the mounting shank and the mounting deck. A retainer couples the escutcheon to the mounting ring.

A faucet handle assembly configured to be supported by a mounting deck includes a valve assembly having a movable flow control member and a valve stem operably coupled to the flow control member, and a handle operably coupled to the valve stem of the valve assembly. A mounting shank includes a cylindrical body defining an internal chamber and extending longitudinally between an upper end and a lower end, the cylindrical body including internal threads and external threads, the valve assembly supported within the internal chamber of the mounting shank. A bonnet nut includes external threads engaging with the internal threads of the mounting shank to secure the valve assembly to the mounting shank. An escutcheon is supported intermediate the handle and the mounting shank. A mounting ring is positioned intermediate the mounting shank and the escutcheon. A retainer couples the escutcheon to the mounting ring, the retainer including a threaded connection having internal threads on the escutcheon and mating external threads on the mounting ring.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

A detailed description of the drawings particularly refers to the accompanying figures, in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
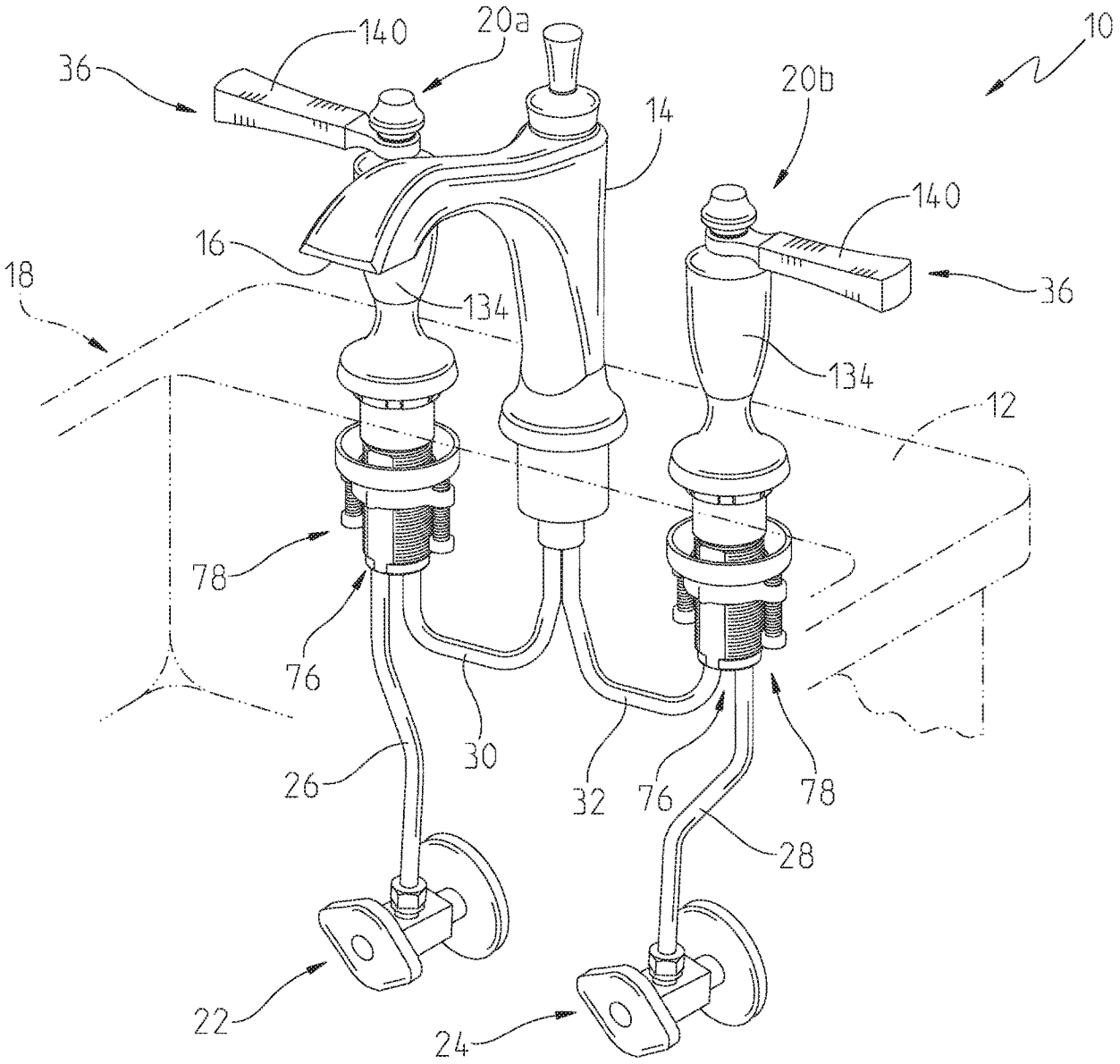
FIG. 1 is a perspective view of an illustrative faucet including reduced profile faucet handle assemblies of the present disclosure.
Figure 2:
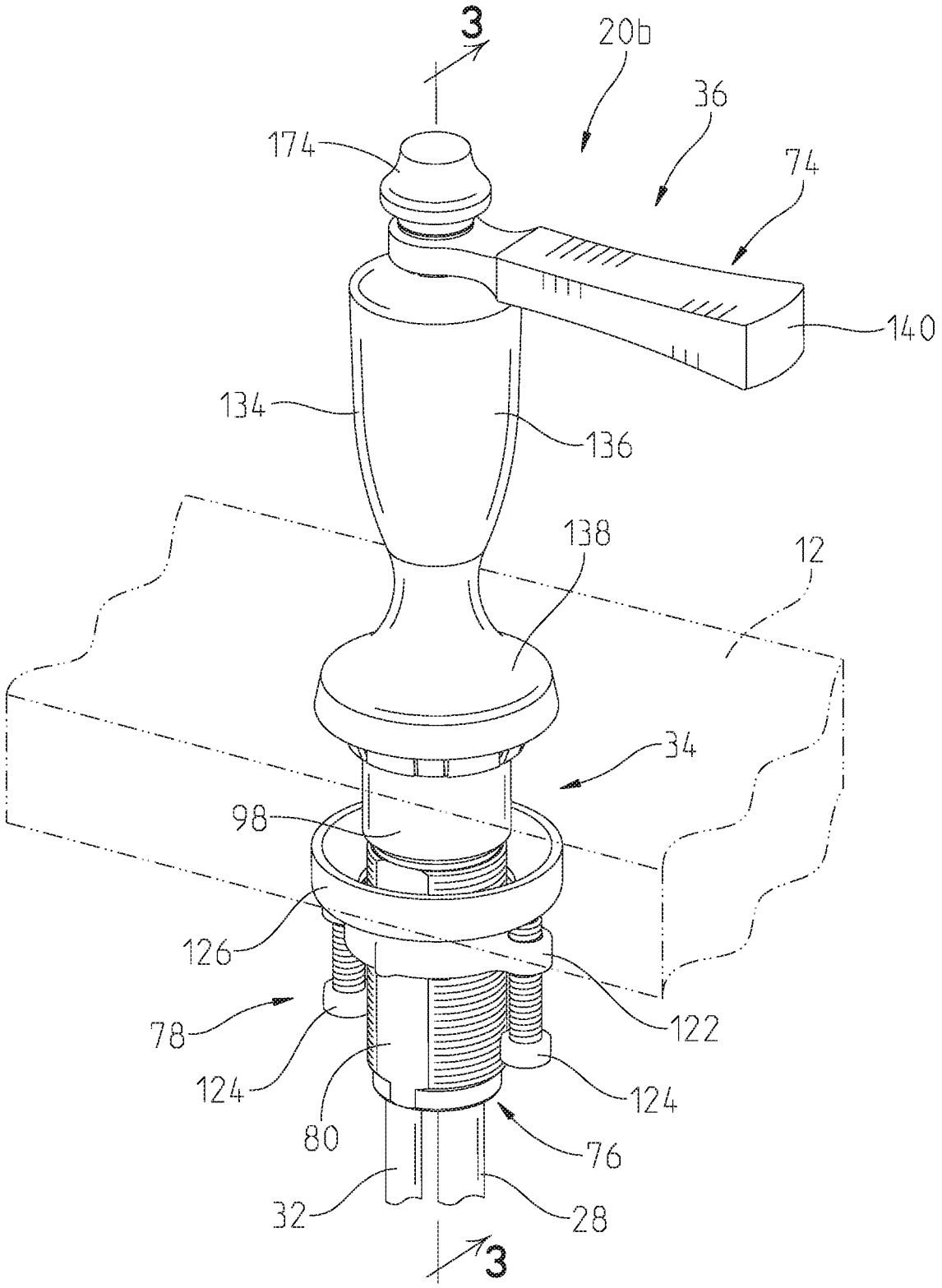
FIG. 2 is a perspective view of the illustrative reduced profile faucet handle assembly of FIG. 1.

Referring initially to FIG. 1, an illustrative faucet 10 is shown coupled to a mounting deck, such as a sink deck 12. The faucet 10 illustratively includes a delivery spout 14 defining a water outlet 16 for discharging water into a sink basin 18 surrounded by the sink deck 12. Illustratively, a hot water faucet handle assembly **20*a* and a cold water faucet handle assembly 20*b* are illustratively mounted on the sink deck 12 in spaced relation to, and on opposite sides of, the spout 14. Hot water is supplied from a hot water source 22 to the hot water faucet handle assembly 20*a*, while cold water is supplied from a cold water source 24 to the cold water faucet handle assembly 20***b*.

Illustratively, hot water and cold water inlet conduits 26 and 28 fluidly couple the hot and cold water sources 22 and 24 to the hot water and cold water faucet handle assemblies 20*a* and 20*b*, respectively. The hot water and cold water inlet conduits 26 and 28 are illustratively formed of a flexible tubular material, such as a polymer (e.g., a cross-linked polyethylene (PEX)). As is known, the faucet handle assemblies 20*a* and 20*b* control water flow to the water outlet 16 of the delivery spout 14. More particularly, the delivery spout 14 is fluidly coupled to outlets of the hot water and cold water faucet handle assemblies 20*a* and 20*b* via hot water and cold water outlet conduits 30 and 32, respectively. The hot water and cold water outlet conduits 30 and 32 are illustratively formed of a flexible tubular material, such as a polymer (e.g., a cross-linked polyethylene (PEX)).

In the following detailed description and accompanying drawings, the cold water faucet handle assembly 20*b* is illustrated and described in further detail. However, faucet handle assemblies 20*a* and 20*b* are substantially identical except for their relative rotation during operation (e.g., counter-clockwise from an off position to a full water flow position for the hot water faucet handle assembly 20*a*, and clockwise from an off position to a full water flow position for the cold water faucet handle assembly 20*b*).

With reference now to FIGS. 2-5, the illustrative faucet handle assembly 20*b* includes a lower portion 34 extending below the sink deck 12, and an upper portion 36 extending above the sink deck 12. The lower portion 34 illustratively includes a valve assembly 38 fluidly coupled to a waterway assembly 40 having a base 42 coupled to the respective water inlet conduit 26, 28 and water outlet conduit 30, 32. The base 42 supports the valve assembly 38 and includes an inlet fluid port 44 and an outlet fluid port 46. A spacer 48 is positioned below the base 42 and cooperates with the respective conduits 26, 28 and 30, 32 to keep them in proper spaced relation to each other.

The illustrative valve assembly 38 includes housing 50 receiving a lower stationary flow control member 52 sealingly engaging an upper movable flow control member 54. A valve stem 56 is operably coupled to the movable flow control member 54, wherein rotation of the valve stem 56 causes similar rotation of the movable flow control member 54. A valve stem adapter 58 is operably coupled to the valve stem 56, illustratively by a fastener, such as a bolt 60. The valve stem adapter 58 illustratively includes a body 62 supporting un upwardly extending splined shaft 64. A limit stop 66 extends downwardly from the body 62 of the valve stem adapter 58 and is configured to engage opposing stop surfaces 68 and 70 on a cap 72 of the valve assembly 38 to limit rotation of the valve stem 56, and thereby the movable flow control member 54. In an illustrative embodiment, the valve assembly 38 may of the type further detailed in U.S. Pat. No. 8,881,755 to Thomas et al., the disclosure of which is expressly incorporated herein by reference.

The upper portion 36 illustratively includes an upper handle 74 operably coupled to the valve stem 56 via the valve stem adapter 58. A holder 76 supports the valve assembly 38 and is secured to the sink deck 12 via a mounting member 78. The holder 76 illustratively includes a mounting shank 80 extending through a mounting aperture 82 in the sink deck 12 and including a cylindrical body 84 defining an internal chamber 86 and extending longitudinally between an upper end 88 and a lower end 90. The cylindrical body 84 illustratively includes upper internal threads 92 extending downwardly from the upper end 88, and lower external threads 94 extending upwardly from the lower end 90. A radially outwardly extending lip of flange 96 is supported by the upper end 88 of the mounting shank 80.

The mounting shank 80 illustratively includes an upper portion or adapter 98 and a lower portion 100 defining the internal chamber 86. Illustratively, the upper portion 98 includes internal threads 102 threadably engaging external threads 104 of the lower portion 100. The upper portion 98 illustratively includes the radially outwardly extending annular flange 96, and the internal threads 92 extending downwardly from the upper end 88.

The valve assembly 38 and the base 42 of the waterway assembly 40 are illustratively received within the internal chamber 86 of the mounting shank 80. The base 42 is illustratively seated against a lip 106 and a bonnet nut 108 secures the base 42 of the waterway assembly 40 and the valve assembly 38 within the mounting shank 80. A gasket 110 is illustratively provided between the base 42 and the lip 106 to provide a fluid seal. An o-ring 112 may be positioned around the base 42 of the waterway assembly 40 to provide a seal with the cylindrical body 84 of the mounting shank 80.

Figure 3:
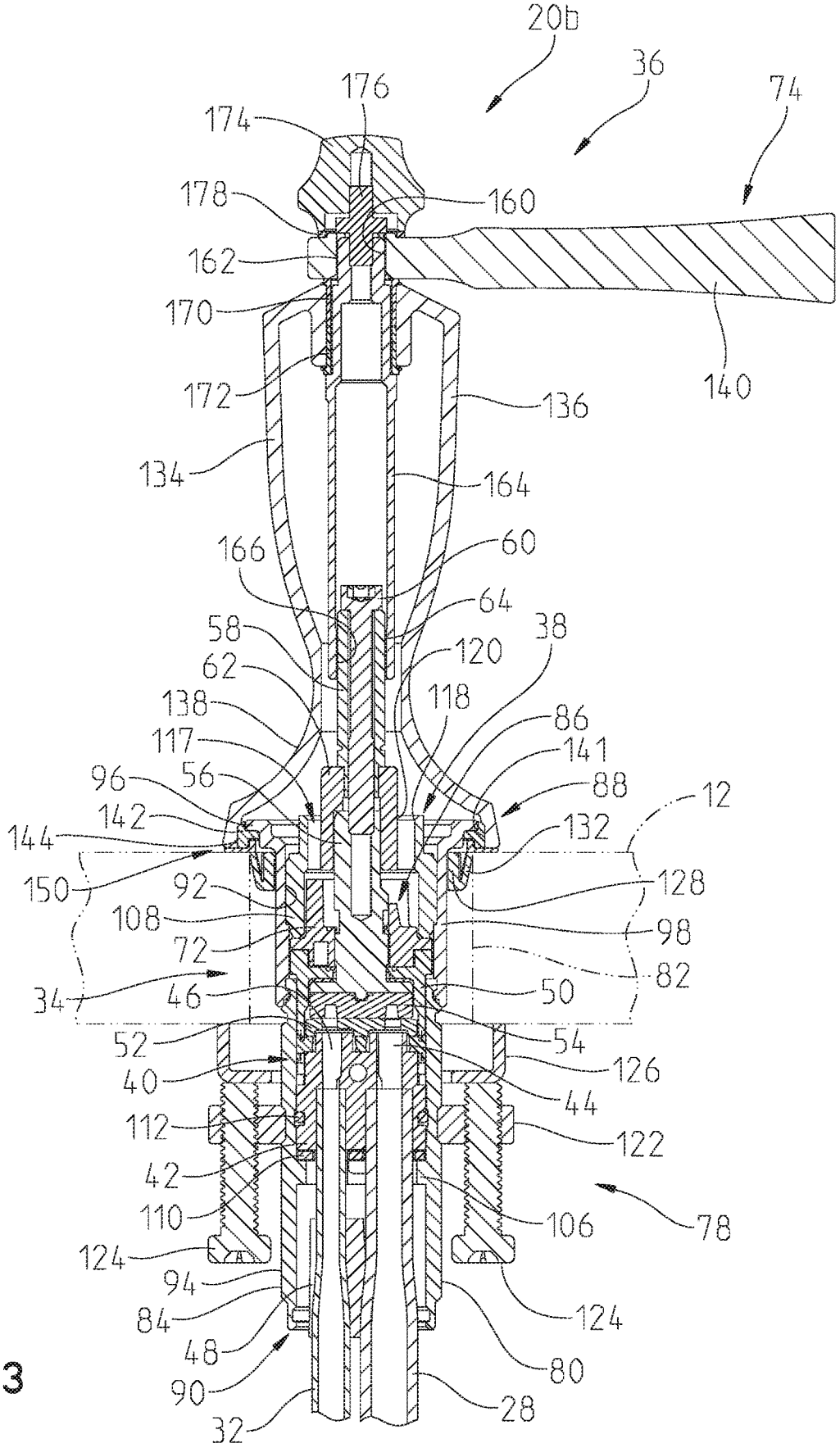
FIG. 3 is a cross-sectional view of the illustrative faucet handle assembly, taken along line 3-3 of FIG. 2.
Figure 4:
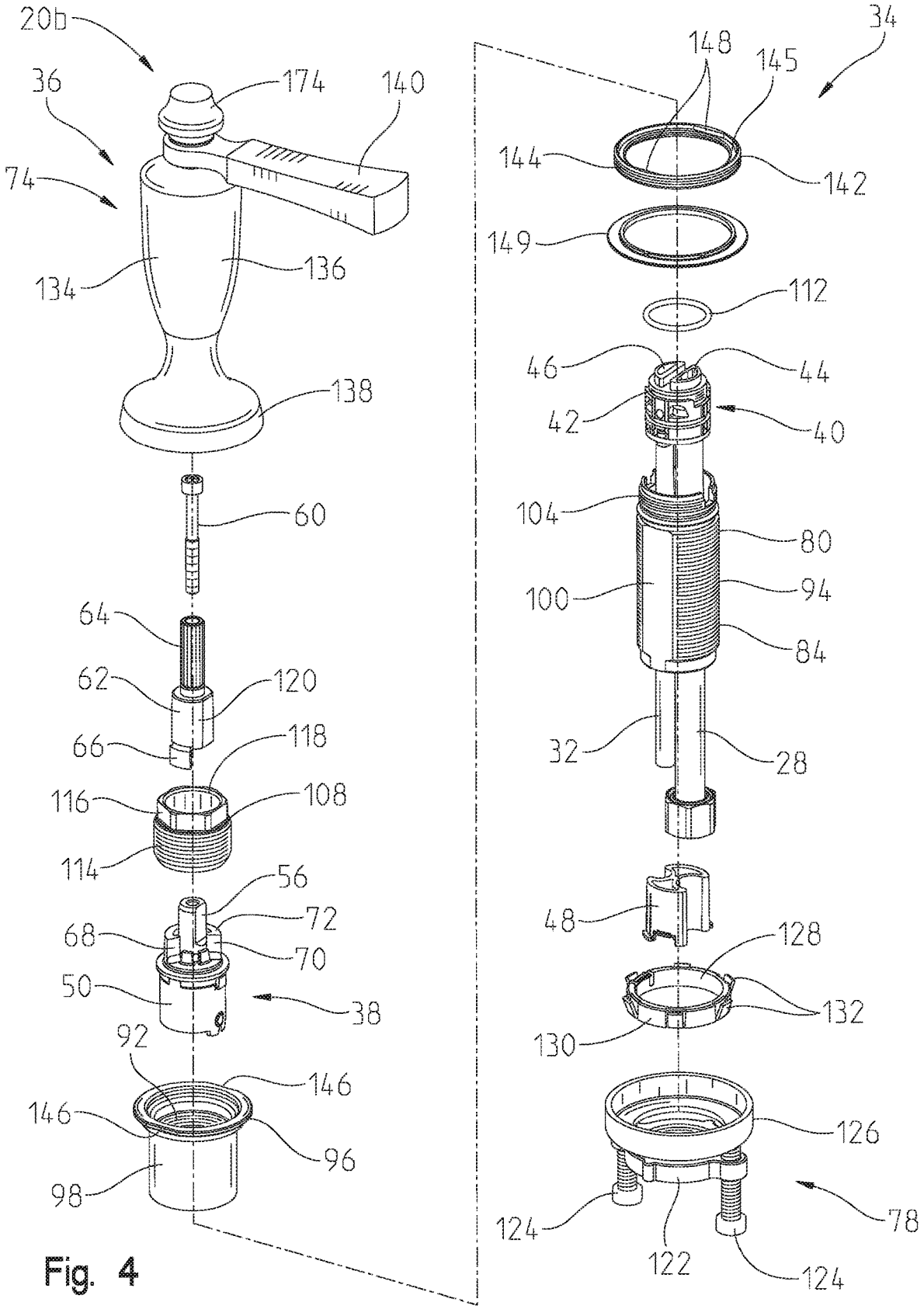
FIG. 4 is a top exploded perspective view of the illustrative faucet handle assembly of FIG. 2.
Figure 5:
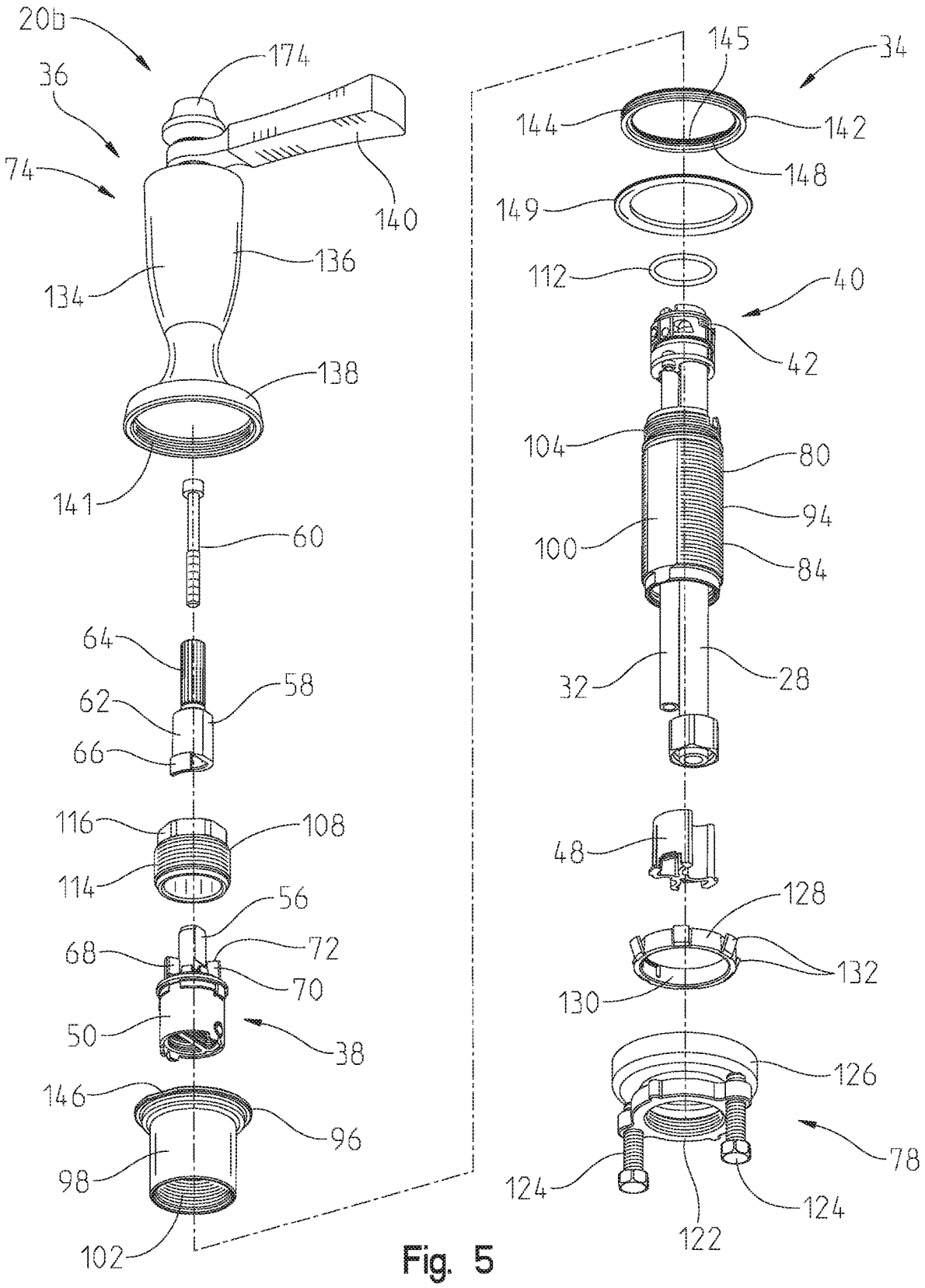
FIG. 5 is a bottom exploded perspective view similar to FIG. 4.

The bonnet nut 108 illustratively includes external threads 114 that mate with the upper internal threads 92 of the mounting shank 80. A tool engagement portion, illustratively a plurality of flats 116 are configured to mate with a tool to facilitate tightening of the bonnet nut 108 within the mounting shank 80. With further reference to FIG. 3, the illustrative valve stem 56 is substantially received within the bonnet nut 108 to prevent undesired pivoting of the valve stem 56 about a transverse pivot axis and hence, wobbling of the upper portion 36 of the faucet handle assembly 20*b*. In an illustrative embodiment, the upper end of the valve stem 56 (e.g., at the connection with the valve stem adapter 58 via the bolt 60) is concentrically positioned at or below the upper end of the bonnet nut 108. Illustratively, a radial gap 117 between an upper edge 118 of the bonnet nut 108 and a laterally adjacent point 120 of the valve stem adapter 58 may be reduced, wherein radial engagement between the edge 118 and the point 120 reduces lateral pivoting or wobbling of the valve stem 56.

The mounting member 78 is operably coupled to the mounting shank 80 to secure the faucet handle assembly 20 to the sink deck 12. A mounting nut 122 threadably engages the lower external threads 94 of the mounting shank 80. Bolts 124 are threadably coupled to the mounting nut 122 and are configured to push against a clamping ring 126 as they are rotated thereby clamping the faucet handle assembly 20*b* to the mounting deck 12.

A stabilizing ring 128 is concentrically received by the mounting shank 80 and is received within the mounting aperture 82. The stabilizing ring 128 illustratively includes an annular body 130 and a plurality of outwardly biased tabs 132. The stabilizing ring 128 is configured to align and prevent lateral movement (e.g., wobbling) of the mounting shank 80 within the mounting aperture 82 of the sink deck 12.

The upper handle 74 illustratively includes an escutcheon or trim 134 including an upper portion 136 and a lower portion 138. The escutcheon 134 is supported intermediate a handle lever 140 and the mounting shank 80. The lower portion 138 illustratively includes internal threads 141. A mounting ring 142 is positioned intermediate the mounting shank 80 and includes external threads 144 which threadably couple with the internal threads 141 of the escutcheon 134. Illustratively, an annular lip 145 is positioned intermediate the flange 96 of the mounting shank 80 and the sink deck 12.

In the illustrative embodiment, the mounting ring 142 is positioned between the upper flange 96 of the mounting shank 80 and the sink deck 12. In another illustrative embodiment, the mounting ring 142 may be defined by the upper flange 96 of the mounting shank 80. Anti-rotation members are configured to prevent relative rotation between the upper flange 96 and the mounting ring 142. Illustratively, the anti-rotation members include external flats 146 on the upper flange 96, and cooperating internal flats 148 on the mounting ring 142. A glide ring 149 is illustratively positioned intermediate the escutcheon 134 and the sink deck 12.

Figure 9:
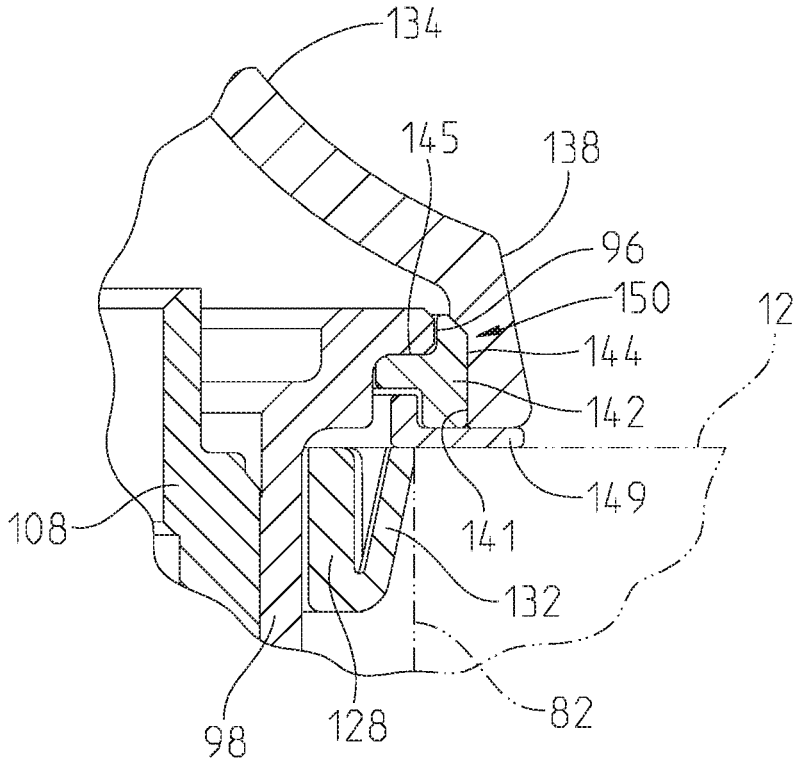
FIG. 9 is a detailed cross-sectional view of the coupling of the faucet escutcheon to the mounting shank.

A retainer 150 couples the escutcheon 134 to the mounting ring 142. In the illustrative embodiment shown in FIG. 9, the retainer 150 includes a threaded connection. More particularly, the external threads 144 on the mounting ring 142 are illustratively coupled to internal threads 141 of the escutcheon 134.

Figure 10:
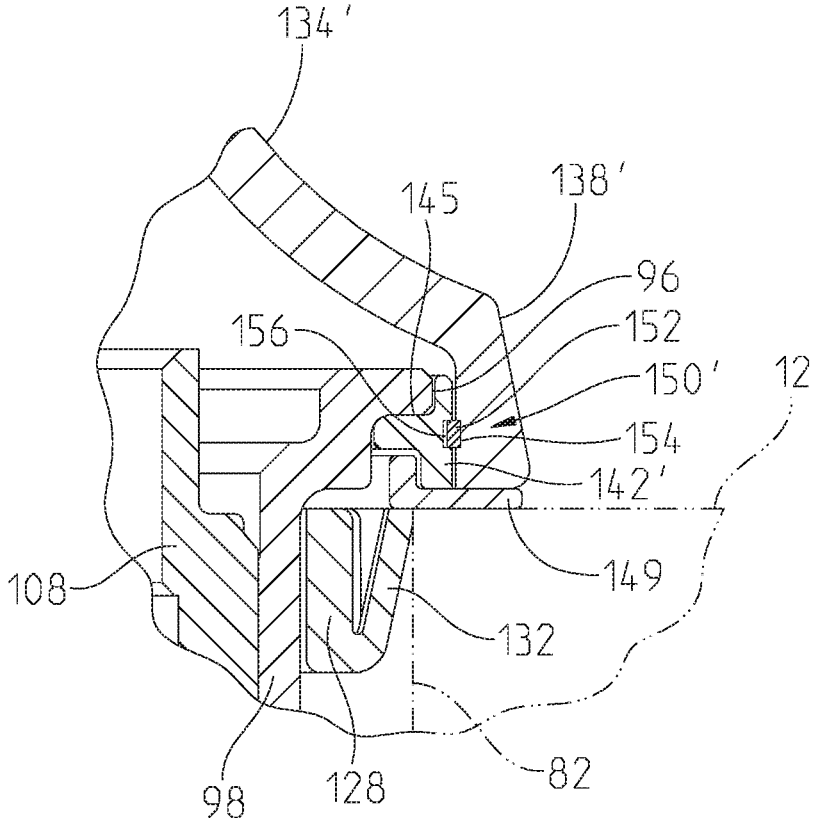
FIG. 10 is a detailed cross-sectional view of an alternative coupling of the faucet escutcheon to the mounting shank.

In the illustrative embodiment shown in FIG. 10, the retainer 150' includes a snap ring 152. More particularly, a first groove 154 is formed within the escutcheon 134', a second groove 156 is formed within the mounting ring 142', and the snap ring 152 extends between the first groove 154 and the second groove 156.

Figure 6:
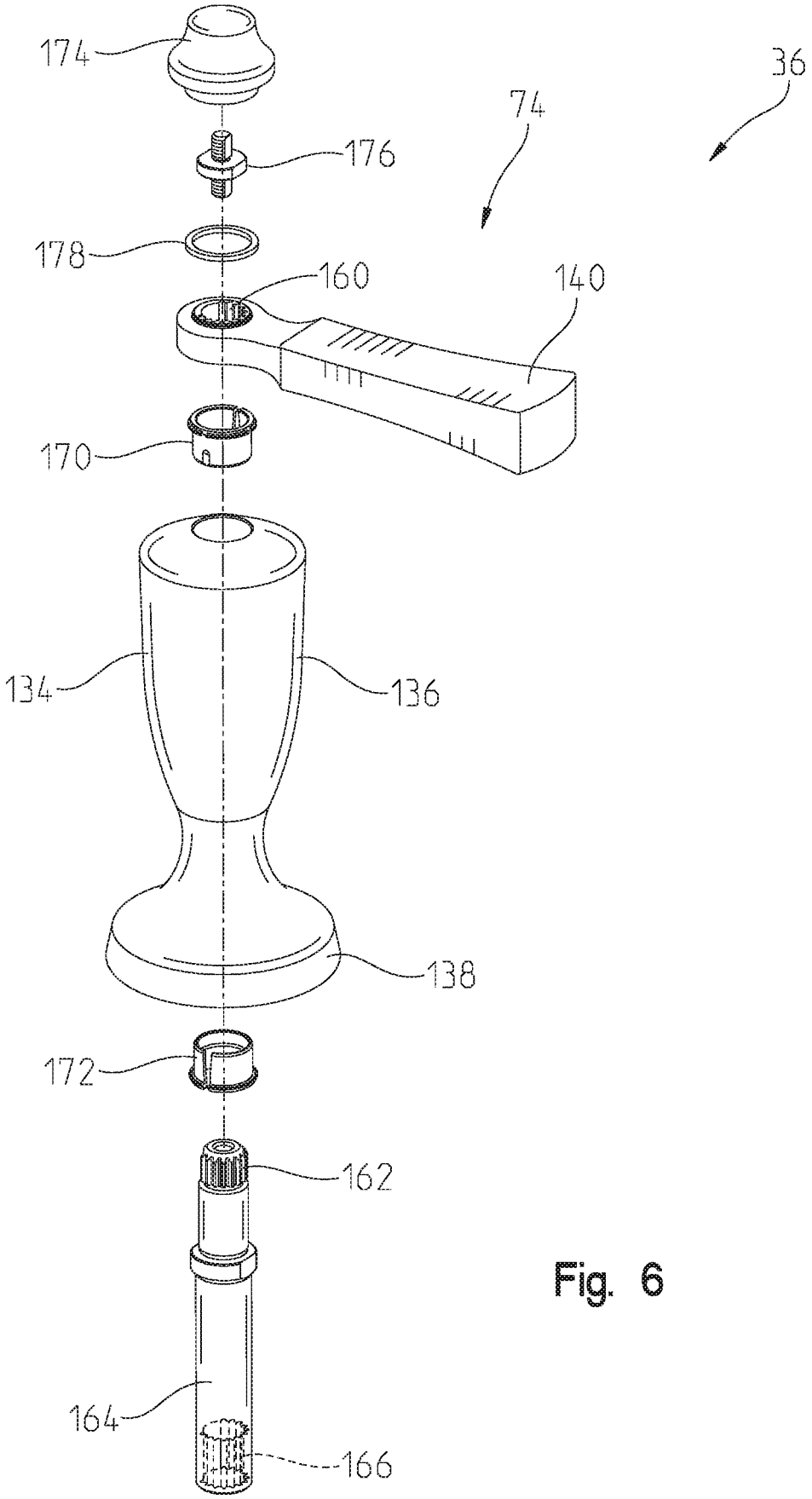
FIG. 6 is an exploded perspective view of an upper portion of the faucet handle assembly of FIG. 2.
Figure 7:
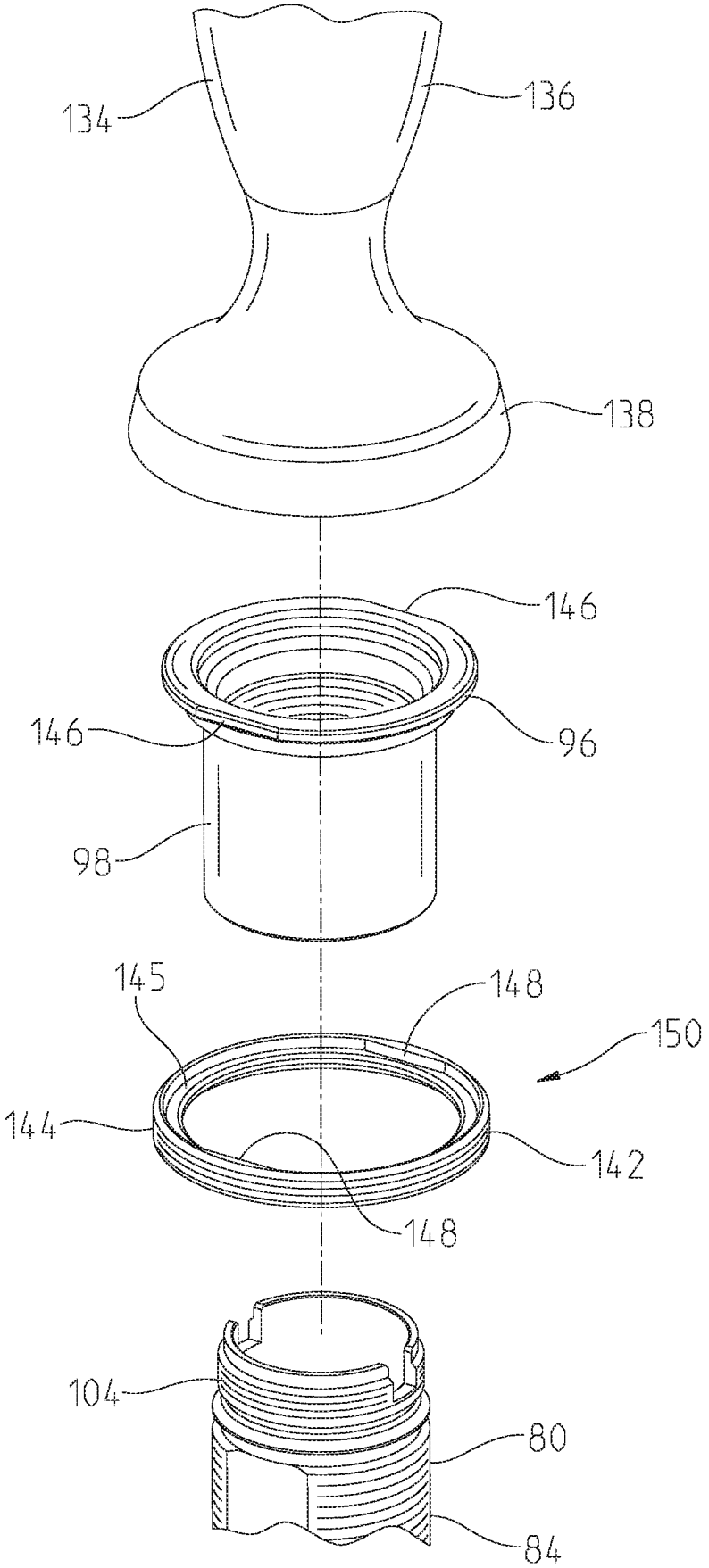
FIG. 7 is a detailed upper exploded perspective view illustrating the coupling of the faucet escutcheon to the mounting shank.
Figure 8:
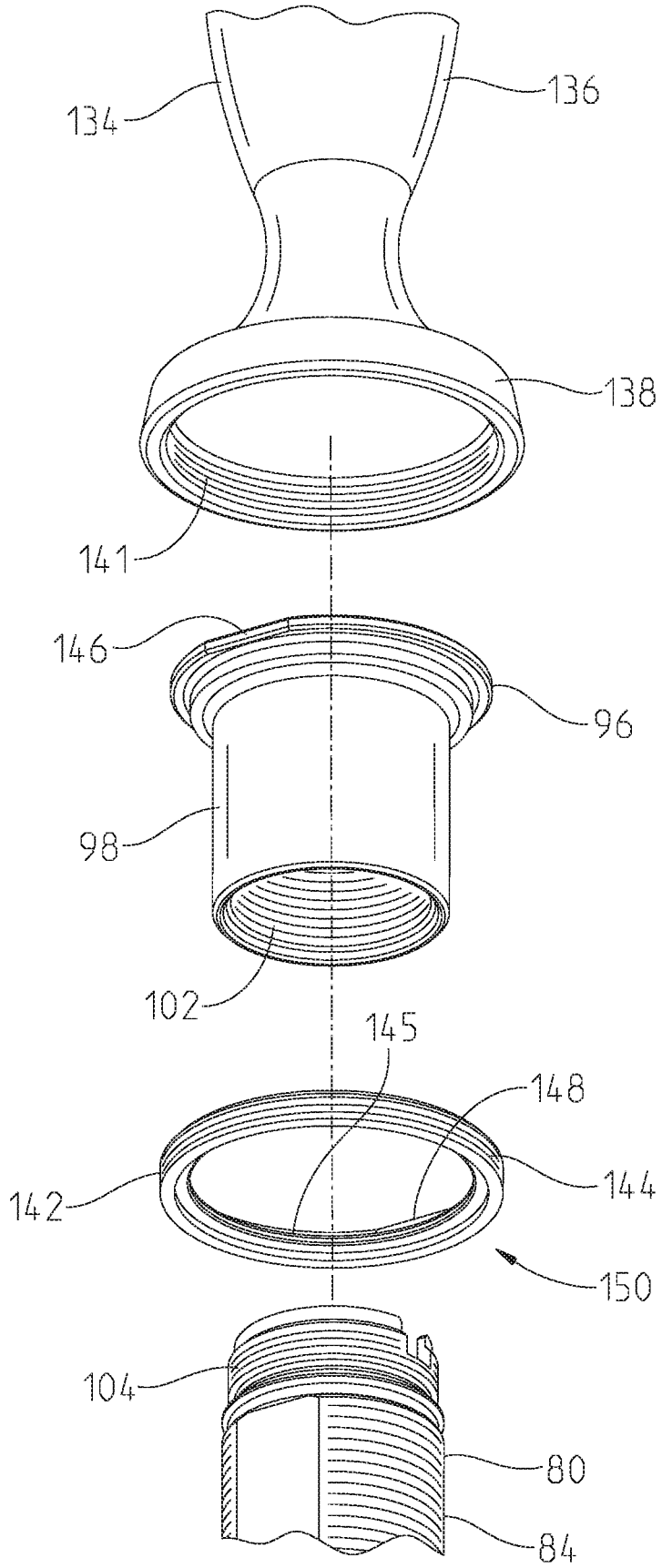
FIG. 8 is a detailed bottom exploded perspective view similar to FIG. 7.

With further reference to FIG. 6, the upper portion 36 of the handle assembly 20 illustratively includes the handle lever 140 having internal splines 160 which matingly engage with external splines 162 of an upper end of a stem extension 164. Internal spines 166 of a lower end of the stem extension 164 matingly engage with the splined shaft 64 of the valve stem adapter 58. Upper and lower bushings 170 and 172 are illustratively positioned intermediate the stem extension 164 and the upper end of the escutcheon 134. Radial engagement between the upper end of the stem extension 164 and the upper end of the escutcheon 134 (illustratively, via the bushings 170 and 172), is configured to prevent undesired pivoting of the stem extension 164 about a transverse pivot axis and hence, wobbling of the upper portion 36 (including the handle lever 140) of the faucet handle assembly 20*b*. A finial 174 may be positioned above the handle lever 140. A threaded adapter 176 illustratively couples the finial 174 to the upper end of the stem extension 164. A glide ring 178 is illustratively positioned intermediate the handle lever 140 and the finial 174.

Although the invention has been described in detail with reference to certain preferred embodiments, variations and modifications exist within the spirit and scope of the invention as described and defined in the following claims.

The invention claimed is:

1. A faucet handle assembly configured to be supported by a mounting deck, the faucet handle assembly comprising:

a valve assembly including a movable flow control member and a valve stem operably coupled to the flow control member;

a handle operably coupled to the valve stem of the valve assembly;

a mounting shank including a cylindrical body defining an internal chamber and extending longitudinally between an upper end and a lower end, the cylindrical body including internal threads extending downwardly from the upper end and external threads extending upwardly from the lower end, and a radially outwardly extending upper flange supported by the upper end of the cylindrical body, the valve assembly supported within the internal chamber of the mounting shank;

a bonnet nut including external threads engaging with the internal threads of the mounting shank to secure the valve assembly to the mounting shank;

an escutcheon supported intermediate the handle and the mounting shank;

a mounting ring positioned radially intermediate the mounting shank and the escutcheon, the mounting ring including a radially inwardly extending lip, the upper flange of the mounting shank supported by the lip of the mounting ring, the lip of the mounting ring configured to be positioned axially intermediate the upper flange of the mounting shank and the mounting deck; and a retainer coupling the escutcheon to the mounting ring.

2. The faucet handle assembly of claim 1, further comprising anti-rotation members configured to prevent relative rotation between the upper flange and the mounting ring.

3. The faucet handle assembly of claim 2, wherein the anti-rotation members include an external flat on the upper flange, and a cooperating internal flat on the mounting ring.

4. The faucet handle assembly of claim 1, wherein the retainer comprises a threaded connection.

5. The faucet handle assembly of claim 4, wherein the threaded connection includes radially inwardly extending internal threads on the escutcheon and mating radially outwardly extending external threads on the mounting ring.

6. The faucet handle assembly of claim 1, wherein the retainer comprises a snap ring.

7. The faucet handle assembly of claim 6, wherein the escutcheon includes a first groove, the mounting ring includes a second groove, the snap ring extending between the first groove and the second groove.

8. The faucet handle assembly of claim 1, further comprising a stabilizing ring concentrically received by the mounting shank and received within a mounting aperture of the mounting deck.

9. The faucet handle assembly of claim 1, further comprising a mounting member threadably engaging the external threads of the mounting shank, the mounting member configured to be positioned below the mounting deck.

10. The faucet handle assembly of claim 1, wherein the valve stem is substantially positioned in an axial direction within the bonnet nut, wherein the bonnet nut restricts pivoting of the valve stem about a lateral axis.

11. A faucet handle assembly configured to be operably coupled to a valve assembly including a movable valve stem and supported by a mounting deck, the faucet handle assembly comprising:

a handle operably coupled to the valve stem of the valve assembly;

a mounting shank including a cylindrical body defining an internal chamber and extending longitudinally between an upper end and a lower end, and an upper flange supported by the upper end, the cylindrical body including internal threads and external threads, the valve assembly supported within the internal chamber of the mounting shank;

a bonnet nut including external threads engaging with the internal threads of the mounting shank to secure the valve assembly to the mounting shank;

an escutcheon supported intermediate the handle and the mounting shank;

a mounting ring positioned radially intermediate the mounting shank and the escutcheon, the mounting ring including a radially inwardly extending lip, the upper flange of the mounting shank supported by the lip of the mounting ring, the lip of the mounting ring configured to be positioned axially intermediate the upper flange of the mounting shank and the mounting deck; and a threaded connection coupling the escutcheon to the mounting ring, wherein the threaded connection includes internal threads on the escutcheon and mating external threads on the mounting ring.

12. The faucet handle assembly of claim 11, further comprising anti-rotation members configured to prevent relative rotation between the upper flange and the mounting ring.

13. The faucet handle assembly of claim 12, wherein the anti-rotation members include an external flat on the upper flange, and a cooperating internal flat on the mounting ring.

14. The faucet handle assembly of claim 11, further comprising a stabilizing ring concentrically received by the mounting shank and received within a mounting aperture of the mounting deck.

15. The faucet handle assembly of claim 11, further comprising a mounting member threadably engaging the external threads of the mounting shank, the mounting member configured to be positioned below the mounting deck.

16. The faucet handle assembly of claim 11, wherein the valve stem is substantially positioned in an axial direction within the bonnet nut, wherein the bonnet nut restricts pivoting of the valve stem about a lateral axis.

17. A faucet handle assembly configured to be supported by a mounting deck, the faucet handle assembly comprising:

a valve assembly including a movable flow control member and a valve stem operably coupled to the flow control member;

a handle operably coupled to the valve stem of the valve assembly;

a mounting shank including a cylindrical body defining an internal chamber and extending longitudinally between an upper end and a lower end, the cylindrical body including internal threads extending downwardly from the upper end and external threads extending upwardly from the lower end, and a radially outwardly extending upper flange supported by the upper end of the cylindrical body, the valve assembly supported within the internal chamber of the mounting shank;

a bonnet nut including a plurality of external threads engaging with the internal threads of the mounting shank to secure the valve assembly to the mounting shank;

an escutcheon supported intermediate the handle and the mounting shank;

a mounting ring positioned radially intermediate the mounting shank and the escutcheon, the mounting ring including a radially inwardly extending lip, the upper flange of the mounting shank supported by the lip of the mounting ring, the lip of the mounting ring configured to be positioned axially intermediate the upper flange of the mounting shank and the mounting deck;

a retainer coupling the escutcheon to the mounting ring, the retainer including a threaded connection having radially inwardly extending internal threads on the escutcheon and mating radially outwardly extending external threads on the mounting ring;

wherein the valve stem is substantially positioned in an axial direction within the bonnet nut, wherein the bonnet nut restricts pivoting of the valve stem about a lateral axis; and anti-rotation members configured to prevent relative rotation between the upper flange and the mounting ring, the anti-rotation members including an external flat on the upper flange, and a cooperating internal flat on the mounting ring.

* * * * *